US008562352B2

(12) United States Patent
Fairweather

(10) Patent No.: US 8,562,352 B2
(45) Date of Patent: Oct. 22, 2013

(54) SYSTEMS, METHODS AND APPARATUS INVOLVING FAIRWEATHER FACES COSMETICS BRUSHES AND FACE CHARTS

(76) Inventor: Andrea B. Fairweather, Brooklyn, NY (US)

( * ) Notice: Subject to any disclaimer, the term of this patent is extended or adjusted under 35 U.S.C. 154(b) by 665 days.

(21) Appl. No.: 13/065,529

(22) Filed: Jul. 6, 2009

(65) Prior Publication Data

US 2011/0284019 A1 Nov. 24, 2011

Related U.S. Application Data

(60) Provisional application No. 61/134,332, filed on Jul. 9, 2008, provisional application No. 61/212,260, filed on Apr. 9, 2009.

(51) Int. Cl.
*G09B 19/18* (2006.01)

(52) U.S. Cl.
USPC ..... 434/100

(58) Field of Classification Search
USPC ..... 434/81, 94, 98, 99, 100, 377; 132/293, 132/294, 319, 216, 218; 15/159.1, 160, 15/207, 207.2
See application file for complete search history.

(56) References Cited

U.S. PATENT DOCUMENTS

| | | | | |
|---|---|---|---|---|
| 2,721,561 | A * | 10/1955 | Dyche | 401/129 |
| 6,250,927 | B1 * | 6/2001 | Narlo | 434/100 |
| 6,631,806 | B2 * | 10/2003 | Jackson | 206/581 |
| 6,739,345 | B2 * | 5/2004 | Stanley, III | 132/200 |
| 6,743,020 | B2 * | 6/2004 | Pestl | 434/100 |
| 7,165,559 | B1 * | 1/2007 | Goodman | 132/294 |
| 7,537,120 | B1 * | 5/2009 | Cardenas | 206/581 |
| 2006/0188850 | A1 * | 8/2006 | Mills | 434/100 |
| 2007/0186946 | A1 * | 8/2007 | Castleberry | 132/200 |
| 2008/0141479 | A1 * | 6/2008 | Mink | 15/207.2 |
| 2009/0235946 | A1 * | 9/2009 | Kalla et al. | 132/200 |

* cited by examiner

*Primary Examiner* — Kurt Fernstrom
(74) *Attorney, Agent, or Firm* — Curran Patent Law; Kevin M. Curran, Esq.

(57) ABSTRACT

Systems, methods and apparatus are disclosed involving cosmetics brushes and face charts for strategic application of make-up. In particular, embodiments of the invention involve cosmetics brushes having markings color-coded to match make-up types, locations, and application steps within a sequence, as depicted on a corresponding face chart for the strategic application of make-up to achieve a desired look, using, for example, a code key to explain the face chart. Each desired look may have a specific face chart that uses color-coded markings to match a brush with a make-up type, location, and step, for a given purpose. Numerous other aspects are provided.

15 Claims, 11 Drawing Sheets

Fairweather Faces (Professional, Travel Size, Color-Coded, Multi-Functional)

*Make-up Brushes*

Match color of Make-up Brush to Dot on Face Chart, and SNAP! Apply your Make-up like the Pros...

*These 'space saver / multi-functional brushes' are not only cute but a necessary tool for Professional Make-up Artists and Everyday Clientele. The hairs are cut in layers to create an effortless, flawless make-up application.*

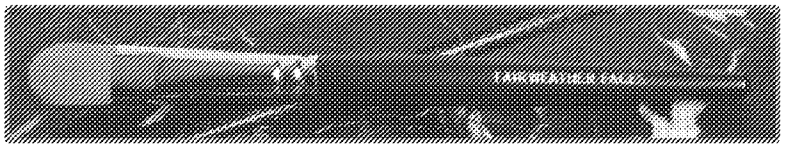

Camouflage-Use to apply concealor / spot treatment or overall foundation

Bonus: Great for applying cream eyeshadow

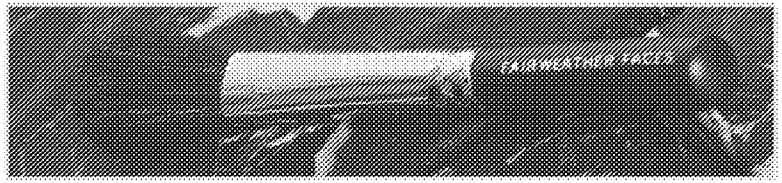

Chisel Blush-Multi-functional: Powder Bronzer-Simply tissue off in between each use Bonus: Overall blending tool

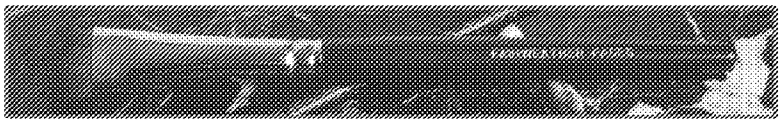

Chisel Deluxe Fluff-Perfect for quick,full eyeshadow applications

Bonus:Can blend cream eyeshadows

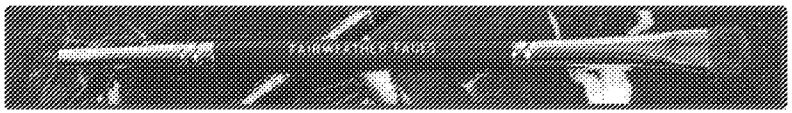

Mini Detail/Deluxe-Standard eyeshadow/ liner brush-Use to define or soften

Bonus: Use dry or wet

Brush Care Wash by holding handle downward (wet hairs only in running luke warm water); Lather with baby shampoo; Rinse(hairs only) under cool running water; Gently squeeze out excess water (downward position, away from brush handle): Dry on clean surface-open window sill is best.

FIG. 8

Fairweather Faces (Color-Coded, Multi-Functional)

*Mini Make-up Brushes*

Match color of Make-up Brush to Dot on Face Chart, and SNAP! Apply your Make-up like the Pros...

*These multi-functional brushes with Face Chart, are the tools you need to guide and elevate your make-up skills to do a better make-up application.*

Revolutionary Essential Simplified

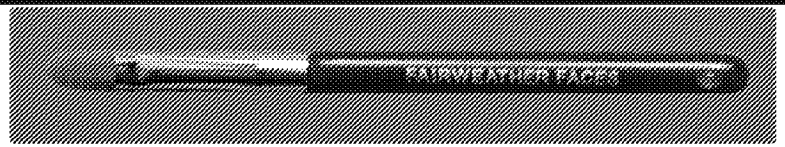

Concealor -Use to apply concealor / spot treatment

Bonus: Use as lip brush

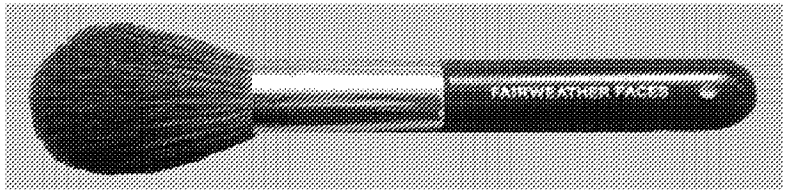

Powder -Bronzer / Blush

Bonus: Overall blending tool

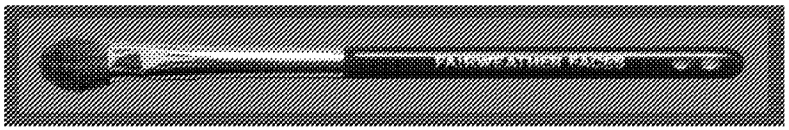

Eyeshadow - Perfect for quick, full eyeshadow applications

Bonus: Use dry or wet

Use to define crease or use tip as smokey liner brush

Bonus: Can be used with all eye make-up bases

Multi-functional Tip: Simply tissue off hairs in between each make-up base use.

Brush Care Wash by holding handle downward (wet hairs only in running luke warm water); Lather with baby shampoo; Rinse(hairs only) under cool running water; Gently squeeze out excess water (downward position, away from brush handle); Dry on clean surface-open window sill is best.

FIG. 9

Fairweather Faces

Travel Size (Color-Coded, Multi-Functional)

*Make-up Brushes*

Match Color-Coded Make-up Brush to the Dot on Face Chart, and SNAP! Apply your Make-up like the Pros...

*These multi-functional brushes with Face Chart, are the tools you need to guide and elevate your make-up skills to do a better make-up application.*

Revolutionary Essential Simplified

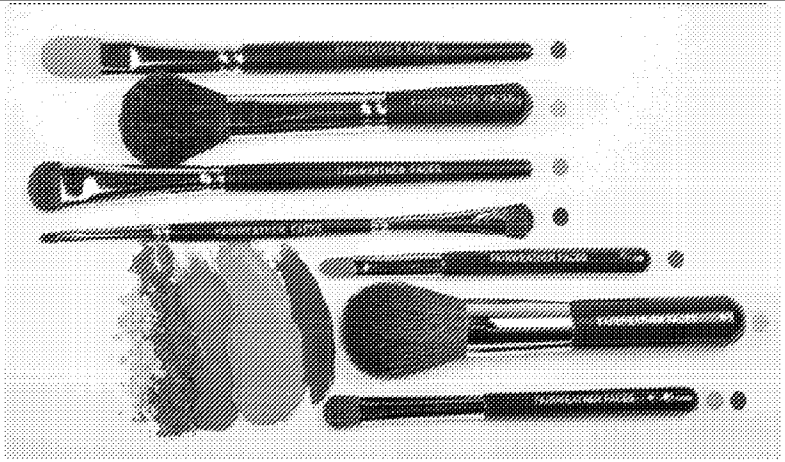

Multi-functional Tip: Simply tissue off hairs in between each make-up base use.

Skin Use to apply concealor / foundation spot treatment

Bonus: Great for applying cream eyeshadow
Use as lip brush

Face - Powder / Bronzer / Blush

Bonus: Preps / Sets make-up
Overall Blending tool

Eyes - Perfect for quick, full eyeshadow applications

Bonus: Use dry or wet
Use to define crease or use tip as smokey liner brush

Bonus: Can be used with all eye make-up bases

Brush Care Wash by holding handle downward (wet hairs only in running luke warm water); Lather with baby shampoo; Rinse(hairs only) under cool running water; Gently squeeze out excess water (downward position, away from brush handle); Dry on clean surface-open window sill is best.

FIG. 11

SYSTEMS, METHODS AND APPARATUS INVOLVING FAIRWEATHER FACES COSMETICS BRUSHES AND FACE CHARTS

CROSS REFERENCE TO RELATED APPLICATIONS

This application is related to and claims the benefit of U.S. Provisional Patent Application Ser. No. 61/134,332 ("the '332 application"), titled "Fairweather Faces Professional (Travel Size, Color-Coded, Multi-functional) Make-up Brushes with Face Chart," and filed 9 Jul. 2008, which is incorporated by reference herein in its entirety for all purposes.

This application is related to and claims the benefit of U.S. Provisional Patent Application Ser. No. 61/212,260 ("the '260 application"), titled "Fairweather Faces Mini (Color-Coded, Multi-functional) Make-up Brushes with Face Chart," and filed 9 Apr. 2009, which is incorporated by reference herein in its entirety for all purposes.

BACKGROUND OF THE INVENTION

1. Field of the Invention

The invention relates to systems, methods, and apparatus involving cosmetics and brushes for the application of make-up. In particular, the invention relates to novel face charts for the application of make-up to a face using novel brushes that coordinate with make-up type and with make-up application location.

2. Description of Related Art

The related art includes, for instance, assorted cosmetics brushes and assorted types of make-up. The prior art also includes images, such as magazine photos, of people, typically women, wearing make-up, in varying quantities, colors, types, locations, styles, etc. In some instances, a series of photos may depict step-by-step application of make-up to achieve a particular result.

As a Celebrity/Everyday client Make-up Artist for over 25 years, I listened to clients' concerns about not knowing how to duplicate or create a professional-looking make-up application on themselves. They are high profile clients seen on television, as well as career-oriented professionals, mothers, teens and aspiring make-up artists. They explained that they needed a simplified system or chart (travel size) that could guide them to know how, when, and where to use their make-up brushes. They also desired to save economically and spatially, by purchasing fewer make-up brushes that could be used multiple ways and still create a professional-looking make-up application. They felt at a loss and intimidated when they applied make-up on themselves, as they did not have extra time to figure out the process. Therefore, I created a revolutionary solution to simplify the make-up application process described herein.

BRIEF SUMMARY OF THE INVENTION

The invention is directed to systems, methods, and apparatus involving cosmetics brushes and face charts for strategic application of make-up. In particular, the invention involves cosmetics brushes having markings color-coded to match make-up types, locations, and application steps within a sequence, as depicted on a corresponding face chart for the strategic application of make-up to achieve a desired look. Each desired look may have a specific face chart that uses color-coded markings to match a brush with a make-up type, location, and step, for a given purpose.

An exemplary embodiment includes a color-coded system matching brushes, make-up, location and sequence within a face chart that provides guidance on make-up brush usage and quickens and improves the process to a professional-looking make-up application. For instance, the make-up brushes are designed to be multi-functional by using quality hairs cut in layers, so the brushes may be used in multiple make-up bases, saving both money and space for clients.

The invention affords various features, embodiments, and advantages, such as travel size, color-coded, multi-functional make-up brushes including multiple face charts. The brushes may come in both Professional and Mini designs. The quality and cut of the hair on the brushes may allow the brushes to be used in multiple make-up bases. An exemplary travel size face chart may be color-coded five different ways, for instance, using primary red, yellow, blue, secondary green colors. In addition, the mini brushes also may have color-coded rhinestones. All of the above may work interdependently in order to simplify, quicken and improve (the look of) one's make-up application.

An exemplary face chart may be color-coded based upon, for instance:

(1) Color around each brush's Border in the photo (2) Brush Name with brush description (3) Bonus Application Tip (4) Colored Dots on the model Face on the chart, and (5) Colored Dots on the Make-up Application Instructions.

In accordance with a first aspect of the invention, a method of assisting a user in application of make-up is disclosed, wherein the method comprises: providing the user with a face chart, and providing the user with an explanation of the face chart, such as a code key explaining the face chart. Additional embodiments may include providing the user with one or more cosmetics brushes having markings matching codes on the face chart. The markings may include, for instance, colored rhinestones, whereas the codes may include colored dots having colors that match the colors of the rhinestones.

In accordance with a second aspect of the invention, a system is disclosed, wherein the system comprises: a face chart and an explanation of the face chart, such as a code key explaining the face chart. Additional embodiments may include one or more cosmetics brushes having markings matching codes on the face chart. The markings may include, for instance, colored rhinestones, whereas the codes may include colored dots having colors that match the colors of the rhinestones.

In accordance with a third aspect of the invention, a face chart is disclosed, wherein a face chart comprises a makeup application strategy, an image of at least a portion of a human face and a code key, the image including a first part of the human face depicting bare skin and at least one coded indication on the bare skin, the coded indication identifying a makeup application location of a makeup type. The code key includes makeup information matching the coded indication with the makeup type. The code key also may include brush information matching the coded indication and the makeup type with a cosmetics brush. The image also may include a second part of the human face depicting stylized makeup, the stylized makeup corresponding to a possible result of makeup application in accordance with the makeup application strategy.

The details of exemplary embodiment of the invention are set forth in the accompanying drawings and the description below. Other features, objects, and advantages of the invention will be apparent from the description and drawings, and from the claims.

BRIEF DESCRIPTION OF THE DRAWINGS

By reference to the appended drawings, which illustrate exemplary embodiments of this invention, the detailed description provided below explains in detail various features, advantages and aspects of this invention. As such, features of this invention can be more clearly understood from the following detailed description considered in conjunction with the following drawings, in which the same reference numerals denote the same elements throughout. The exemplary embodiments illustrated in the drawings are not intended to be to scale and are not to be considered limiting of its scope, for the invention may admit to other equally effective embodiments.

The patent or application file contains at least one drawing executed in color. Copies of this patent or patent application publication with color drawings(s) will be provided by the Office upon request and payment of the necessary fee.

FIG. 8 shows a color back view of an exemplary second Face Chart, for Professional Make-up Brushes.

FIG. 9 shows a color back view of an exemplary third Face Chart, for Mini Make-up Brushes.

FIG. 11 shows a color back view of the Theme Face Chart.

DETAILED DESCRIPTION

Exemplary embodiments according to the invention may include, for example, one or more cosmetics brushes. The quality and type of cosmetics brush play important roles in good application of makeup. For instance, FIGS. 1A-1D depict aerial views of fronts of exemplary Professional Make-up Brushes in accordance with aspects of the invention. From top to bottom of FIGS. 1A-1D are a Fluff brush, a Duo brush, a Camouflage brush, and a Powder brush. As depicted in FIGS. 1A-1D, the brush hairs were flattened somewhat to display the outline of hairs; when hairs are released, they resemble a 'dome-like' shape. Similarly, FIGS. 2A-2D depict aerial views of backs of exemplary Professional Make-up Brushes, also shown in order, top to bottom, of Fluff, Duo, Camouflage, and Powder. As shown in FIGS. 2A-2D, brush hairs are displayed in their 'released' state in order to display their 'dome-like' shape. By comparison, FIGS. 3A-3D depict profile views of other exemplary Professional Make-up Brushes.

Figure 1A:
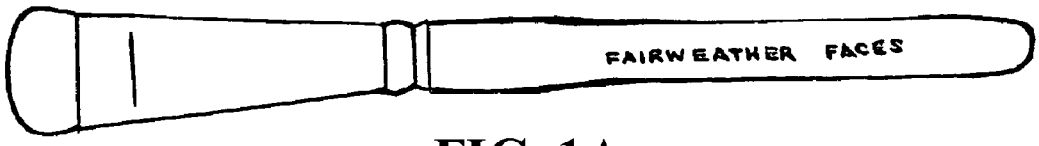
FIGS. 1A-1D depict aerial views of fronts of exemplary Professional Make-up Brushes (Top to Bottom: Fluff, Duo, Camouflage, Powder) (Note: hairs were flattened somewhat to display the outline of hairs; when hairs are released, they resemble a 'dome-like' shape).
Figure 1B:
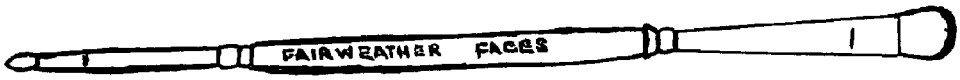
Figure 1C:
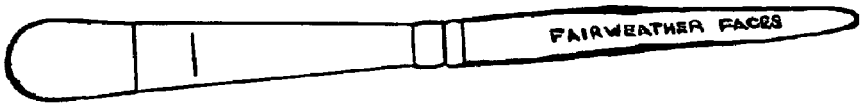
Figure 1D:
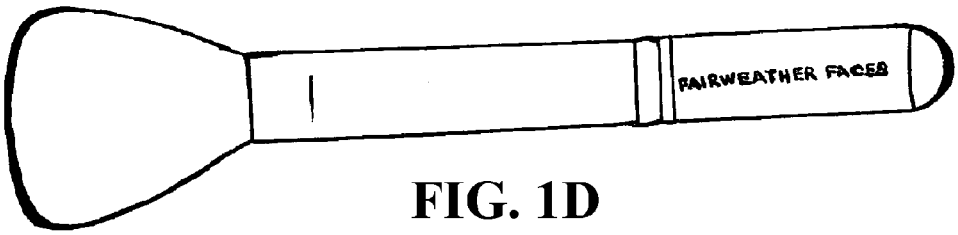
Figure 2A:
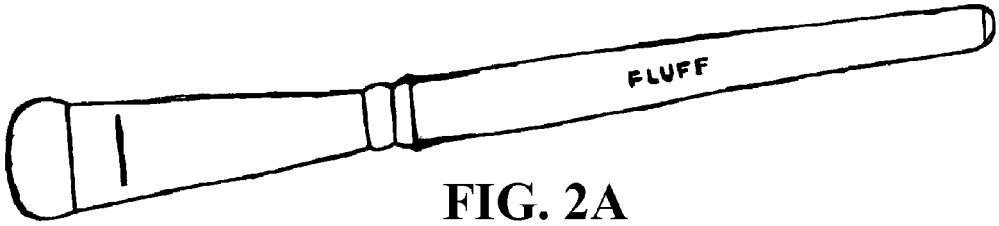
FIGS. 2A-2D depict aerial views of backs of exemplary Professional Make-up Brushes (Top to Bottom: Fluff, Duo, Camouflage, Powder) (Note: hairs are displayed in their 'released' state in order to display their 'dome-like' shape).
Figure 2B:
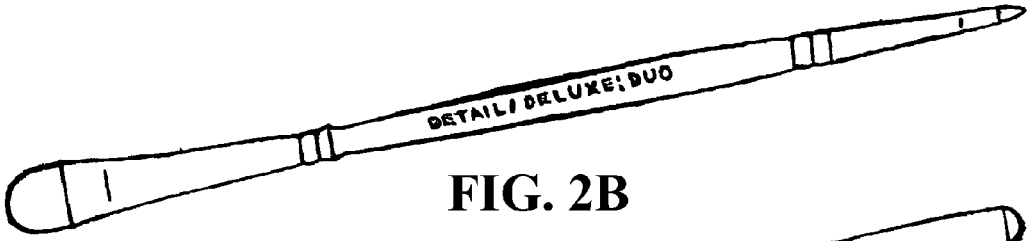
Figure 2C:
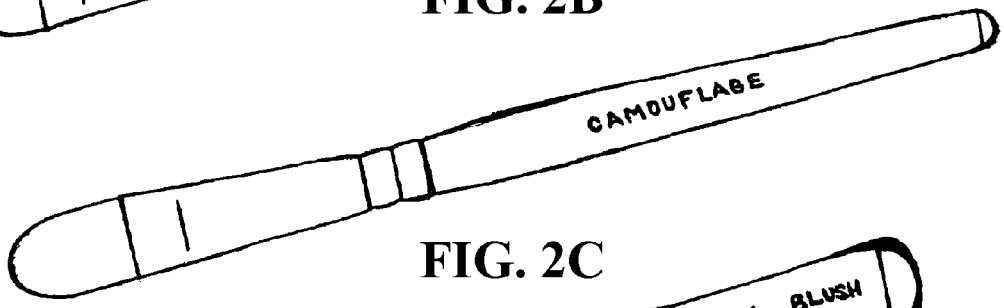
Figure 2D:
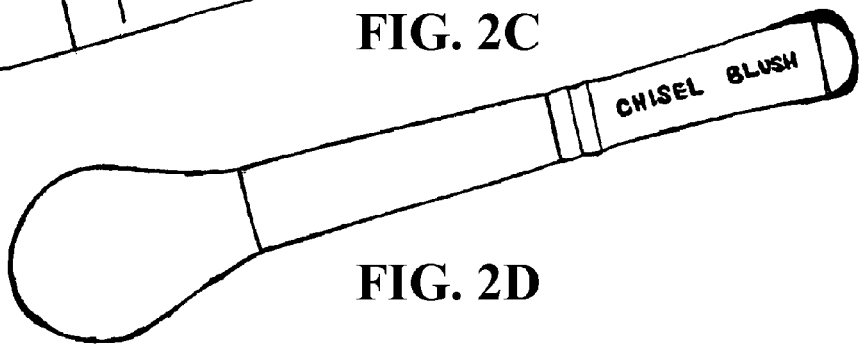
Figure 3A:
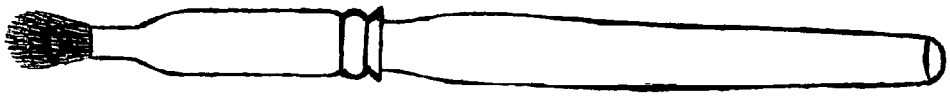
FIGS. 3A-3D depict profile views of exemplary Professional Make-up Brushes.
Figure 3B:
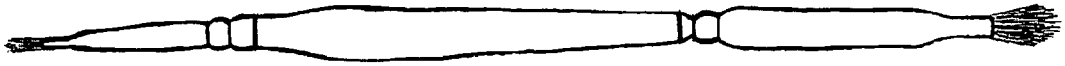
Figure 3C:
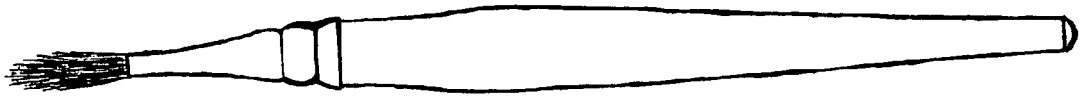
Figure 3D:
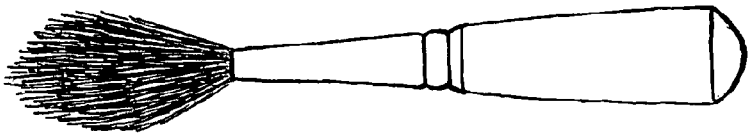
Figure 4:
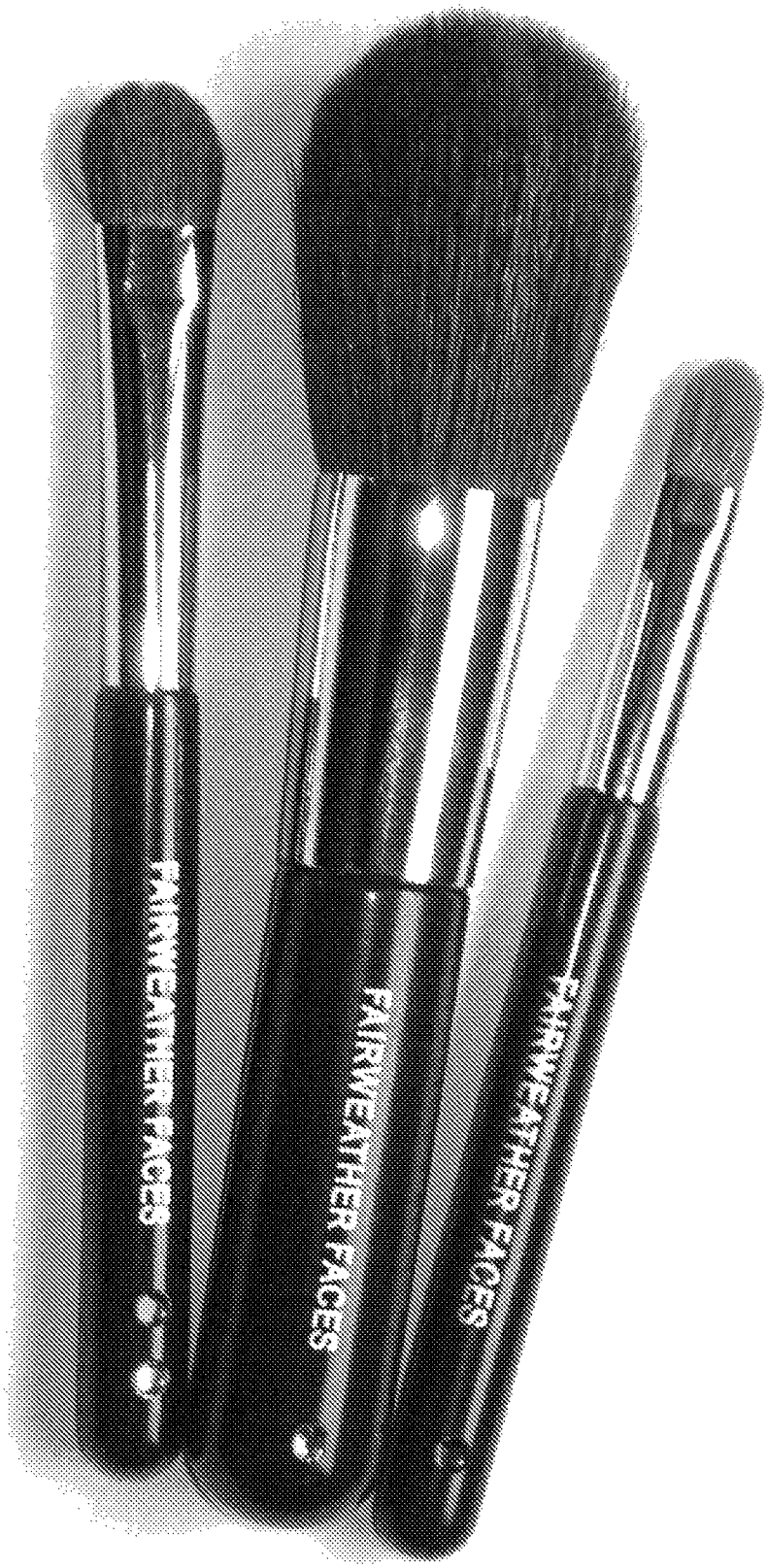
FIG. 4 shows a color photograph of an aerial, upside down view of exemplary Mini Make-up Brushes (Top to Bottom: Eyeshadow, Powder, Concealor), in a view that emphasizes the rhinestones and cut of brush hairs in a 'released' state.
Figure 5A:
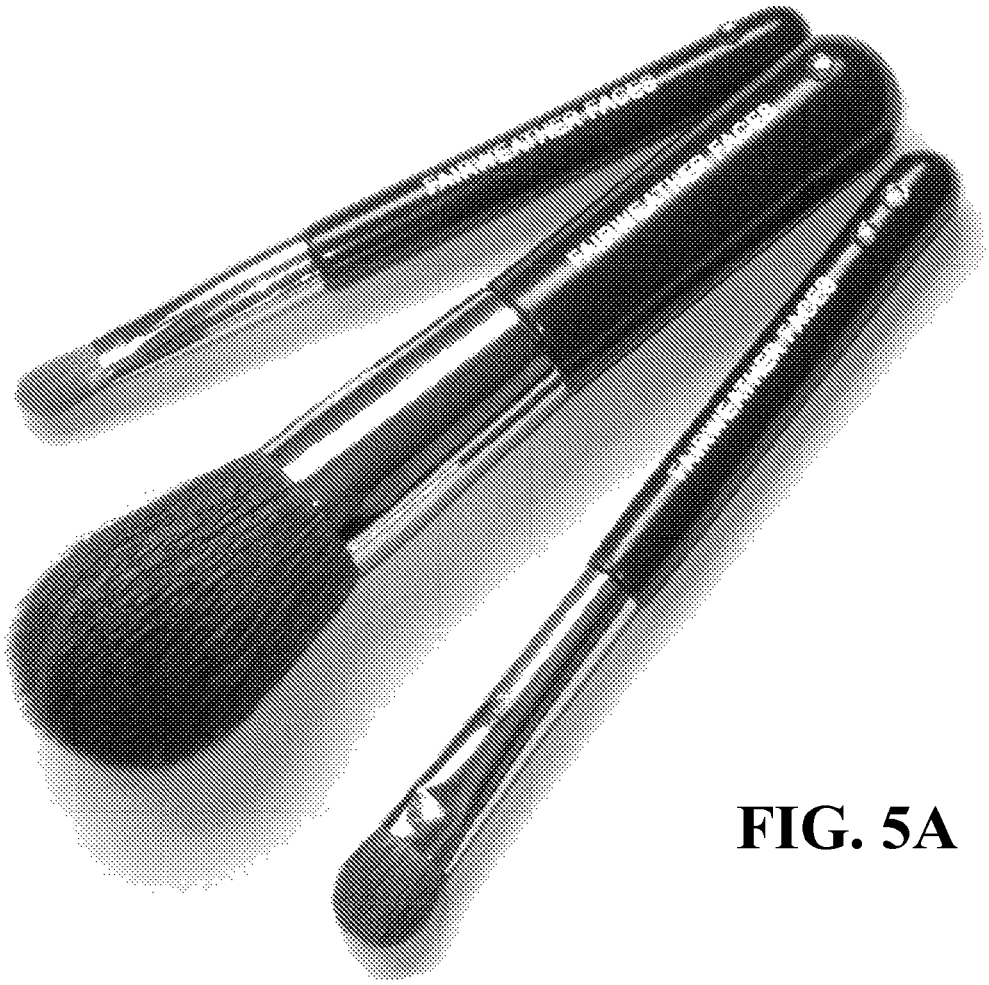
FIGS. 5A and 5B show color photographs of aerial views of exemplary Mini Make-up Brushes (Top to Bottom: Concealor, Powder, Eyeshadow).
Figure 5B:
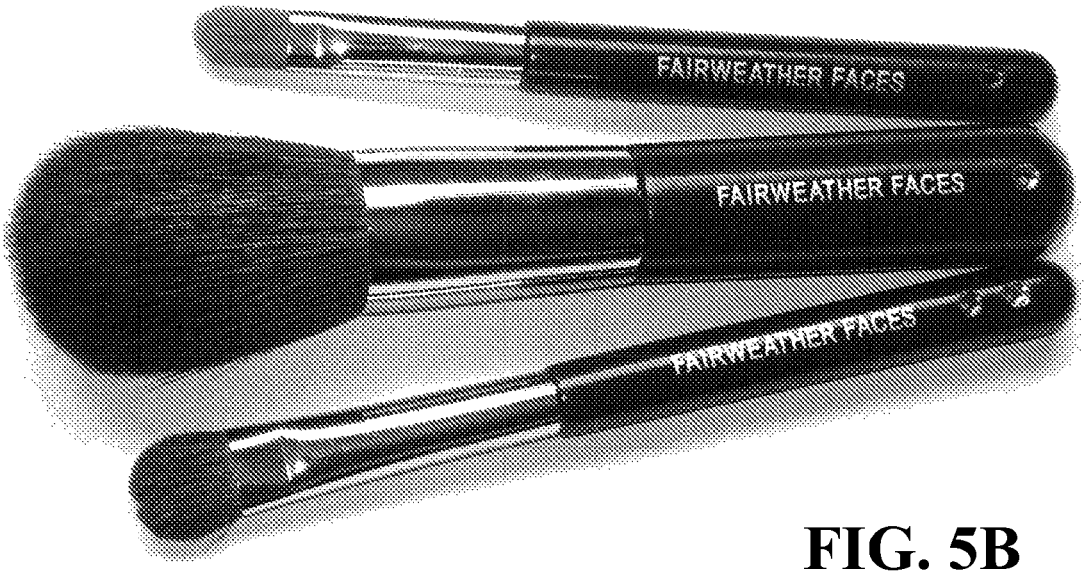

Whereas FIGS. 1-3 depict exemplary embodiments of Professional Makeup Brushes, FIG. 4 shows a color photograph of an aerial, upside down view of exemplary Mini Make-up Brushes. Exemplary embodiments of Mini Makeup Brushes are Travel Sized, Color-Coded, and Multi-functional. As shown, the brushes are, from top to bottom, an Eyeshadow brush, a Powder brush, and a Concealor brush. Each brush of FIG. 4 includes at least one colored rhinestone, and the view of FIG. 4 emphasizes the rhinestones and cut of brush hairs in a 'released' state. Similarly, FIGS. 5A and 5B show color photographs of aerial views of exemplary Mini Make-up Brushes, shown in reverse order of, top to bottom, the Concealor brush, the Powder brush, and the Eyeshadow brush. The rhinestones may function as brush decoration, when considered in isolation, and as coded markings, when considered in conjunction with a similarly-coded face chart.

Figure 6:
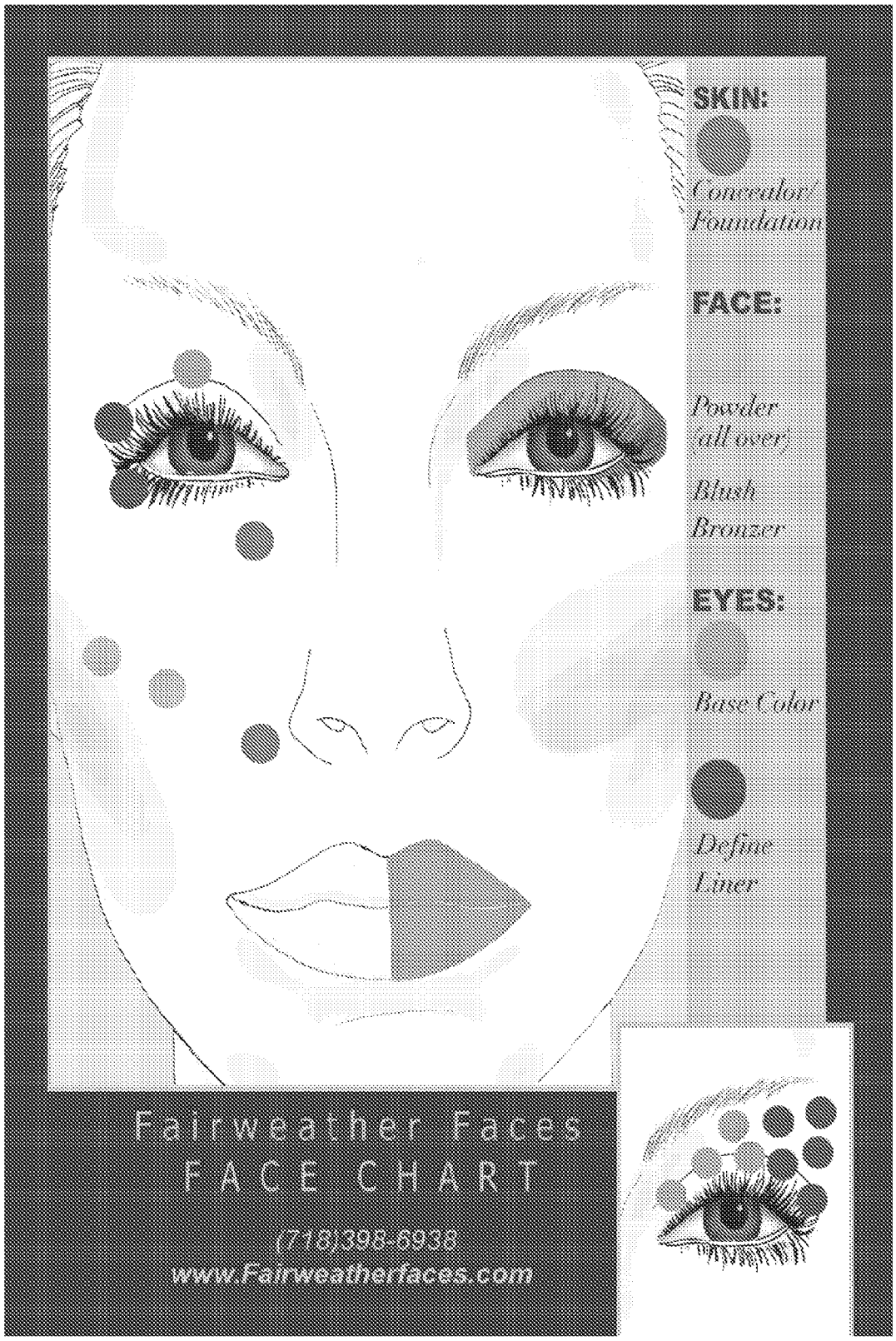
FIG. 6 shows a color front view of an exemplary first Face Chart.
Figure 7:
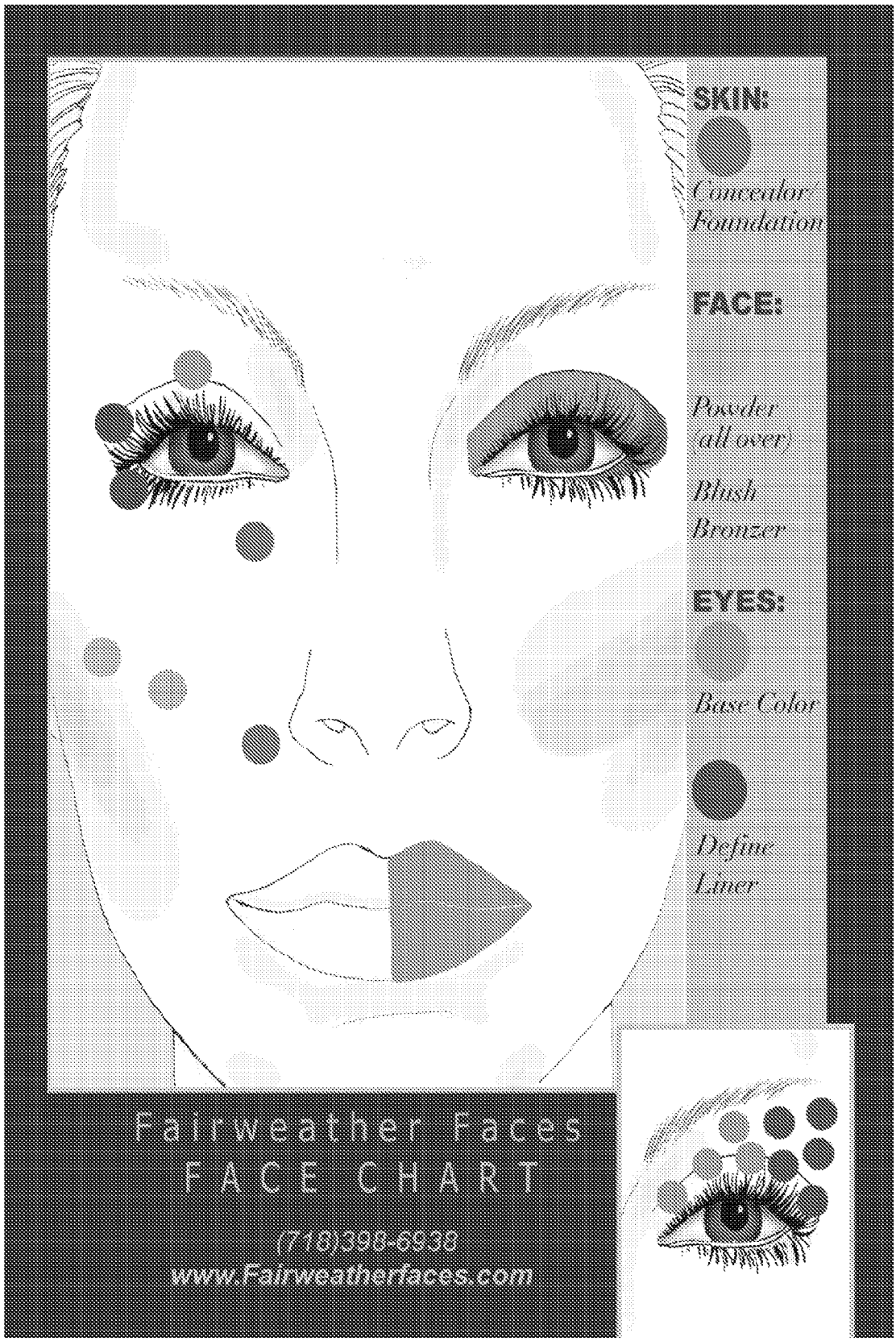
FIG. 7 shows a black and white image of the front view of the first Face Chart of FIG. 6.

In accordance with embodiments of the invention, the choice of brush is guided by reference to a face chart. FIG. 6 shows a color front view of an exemplary first Face Chart, whereas FIG. 7 shows a black and white image of the front view of the first Face Chart of FIG. 6. The face chart comprises a makeup application strategy, an image of at least a portion of a human face and a code key. The image includes a first part of the human face depicting bare skin and at least one coded indication on the bare skin, the coded indication identifying a makeup application location of a makeup type. In FIGS. 6 and 7, the first part appears on the left of the image, corresponding to the right side of the human face. Appearing along a column to the far right on the face chart, the code key includes makeup information matching the coded indication with the makeup type. The code key also may include brush information matching the coded indication and the makeup type with a cosmetics brush. The image also may include a second part of the human face depicting stylized makeup, the stylized makeup corresponding to a possible result of makeup application in accordance with the makeup application strategy. In FIGS. 6 and 7, the second part appears on the right of the image, corresponding to the left side of the human face. In addition, the face chart includes a bonus section in the lower right corner of the image that depicts a more detailed eyeshadow makeup strategy.

The face chart of FIGS. 6 and 7 may appear on a front side of postcard-sized, high-gloss card for convenient transport while traveling. The back side of the card may include further makeup application assistance information. For instance, FIG. 8 shows a color back view of an exemplary second Face Chart, for Professional Make-up Brushes. The makeup application assistance information may include details about brush appearance, type, purpose, functionality, versatility, cleaning, and recommended makeup. For example, the back side includes a photo of each discussed brush. Whereas FIG. 8 describes Professional Makeup Brushes, FIG. 9 describes Mini Make-up Brushes and shows a color back view of an exemplary third Face Chart for Mini Make-up Brushes. The makeup application assistance information may supplement the code key makeup information and explain in more detail how to use the face chart in conjunction with the coded brushes.

Figure 10:
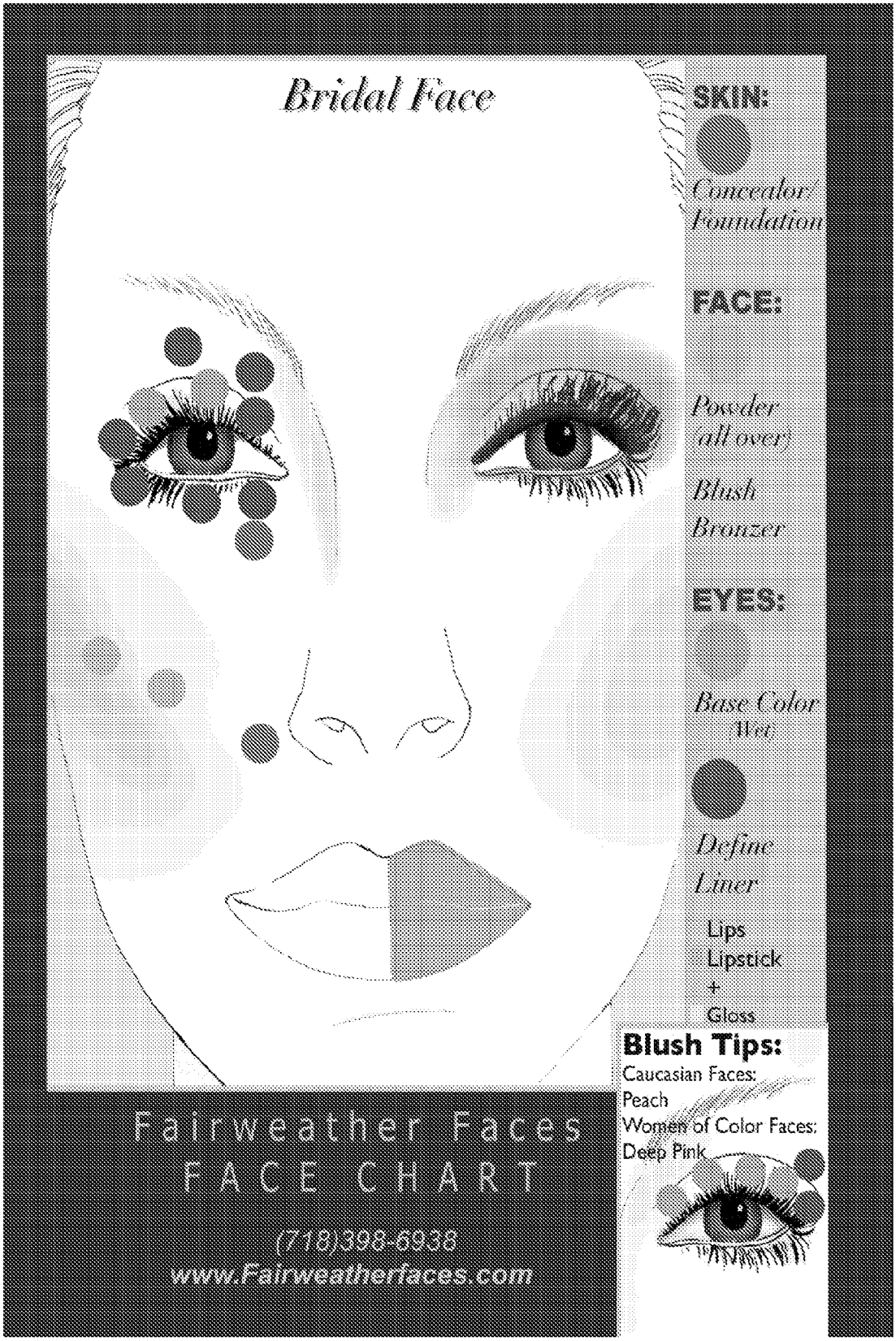
FIG. 10 shows a color front view of an exemplary Theme Face Chart, for a Bridal Face.

The face charts of FIGS. 6 and 7 may be characterized as the original face chart depicting stylized makeup appropriate for many occasions. However, many occasions call for different stylized makeup strategies, and assorted face charts may be directed to specific occasions. For example, FIG. 10 shows a color front view of an exemplary Theme Face Chart for a Bridal Face. A Bridal Face makeup strategy may be tailored, for instance, to address the extended wear and flash-photography issues that arise for a bride on her wedding day. In addition, the bonus section in the lower right corner of FIG. 10 draws a user's attention to possible variations that may arise based on a user's skin type, color, and/or ethnicity. Moreover, entire face charts may be directed at individuals of specific skin type, color and/or ethnicity, including skin age. For instance, other face charts may portray a Teen Face, a Holiday Face, and/or a Summer Face. Inasmuch as Theme Face Charts may be sold independently of the associated coded brushes, the back side of a Theme Face Chart may include makeup application assistance information for both Professional Makeup Brushes and Mini Makeup Brushes, as shown in FIG. 11, which depicts a color back view of the Theme Face Chart.

Exemplary Construction of Professional and Mini Makeup Brushes

Exemplary construction of Professional and Mini Makeup Brushes may include assembly and/or integration of the following components:

High quality—Natural/Synthetic Hairs;

Nickel Ferrules (metal piece that holds brush hairs in place);

Silver colored hot stamp—company name on brushes, e.g.: "Fairweather Faces";

Wooden handles: Professional—Black handles; Mini—Deep Purple handles;

Colored rhinestone(s) on Mini Make-up Brushes, e.g.:

Concealor brush—one Primary Red rhinestone;

Powder brush—one Primary Yellow rhinestone;

Eyeshadow brush—one Secondary Green rhinestone and one Caribbean Water Blue rhinestone.

Hereafter are exemplary constructions of assorted Professional Make-up Brushes that are Travel-Sized, Color-Coded, and Multi-functional.

Exemplary Construction of Camouflage Brushes

Exemplary construction of Camouflage Brushes may include assembly and/or integration of the following components:

Camouflage Brush (5¾ inches)—Hairs (Golden Taklon: Synthetic) ¾ inches from tip of hairs to Nickel Ferrule, width of hairs—½ inch, hair density—⅛ inch;

Nickel Ferrule: length—4¼ cm, width—½ inch at the top, decreases to 1¼ cm at the bottom;

Black Wooden Handle: width—1¼ cm at the top, decreases to ½ cm at the bottom, length—3½ inches;

Color-Code: Primary Red;

"Fairweather Faces" name in Silver hotstamped on one side of brush;

"CAMOUFLAGE" in White hotstamped on the other side;

Applies Concealor/Spot Treatment/Foundation, Bonus—also applies cream, wet, dry eyeshadows;

Result—flawless/blended looking skin appearance.

Exemplary Construction of Chisel Brushes

Exemplary construction of Chisel Brushes may include assembly and/or integration of the following components:

Chisel Blush Brush (4½ inches)—Hairs (Goat) 1¼ inches from tip of hairs to Nickel Ferrule, width of hairs—1½ inches at the top, decreases to ½ inch at the bottom, hair density—½ inch;

Nickel Ferrule: length—1⅞ inches, width—½ inch;

Black Wooden Handle: width—½ inch at the top, decreases to 1 cm at the bottom, length—1⅝ inches;

Color-Code: Primary Yellow;

"Fairweather Faces" name in Silver hotstamped on one side of brush;

"CHISEL BLUSH" in White hotstamped on the other side;

Applies Blush, Bonus—also applies Powder/Bronzer: overall blending tool;

Result—evenly blended, highlighted and contoured cheeks, temples, neck (overall face).

Exemplary Construction of Fluff Brushes

Exemplary construction of Fluff Brushes may include assembly and/or integration of the following components:

Fluff Brush (5½ inches)—Hairs (Pony) 1 cm from tip of hairs to Nickel Ferrule, width of hairs—⅝ inch, hair density—¼ cm;

Nickel Ferrule: length—1⅞ inches, width—1½ cm decreases to ¾ cm;

Black Wooden Handle: width—¾ cm at the top, decreases to ½ cm, length—3⅜ inches;

Color-Code: Secondary Green;

"Fairweather Faces" name in Silver hotstamped on one side of brush;

"FLUFF" in White hotstamped on the other side;

Applies quick, full eyeshadow applications, Bonus—also blends cream, wet, dry eyeshadows;

Result—blends all eyeshadow bases to create even finish, smokey eyes are created in less time (up to two eyeshadow colors—5-7 minutes per eye/Regular time per eye—10-15 minutes).

Exemplary Construction of Detail/Deluxe Duo Brushes

Exemplary construction of Detail/Deluxe Duo Brushes may include assembly and/or integration of the following components:

Detail/Deluxe: Duo Brush (5½ inches) two in one brush: standard eyeshadow/liner brush—Hairs (Pony) (Deluxe side)—¼ inches from tip of hairs to Nickel Ferrule, width of hairs—⅜ inch, hair density—¼ cm;

Nickel Ferrule: length—1⅝ inches, width—⅜ inch at the top, decreases to ½ cm at the bottom, (Detail side)—½ cm from tip of hairs to Nickel Ferrule, width of hairs—¼ cm, hair density—¼ cm;

Nickel Ferrule: length—1¼ inches, width—½ cm at the top, decreases to ¼ cm at the bottom;

Black Wooden Handle—width—½ cm, length—2¼ inches;

Color-Code: Primary Blue;

"Fairweather Faces" name in Silver hotstamped on one side of brush;

"DETAIL/DELUXE DUO" in White hotstamped on the other side; Applies eyeshadow/liner, Bonus—also blends and lines for depth—deeper effects.

Hereafter are exemplary constructions of assorted Mini Make-up Brushes that are Travel-Sized, Color-Coded, and Multi-functional.

Exemplary Construction of Concealor Brushes

Exemplary construction of Concealor Brushes may include assembly and/or integration of the following components:

Concealor Brush (3¾ inches)—Hairs (Synthetic Taklon) 1 cm from tip of hairs to

Nickel Ferrule, width of hairs—¼ inch, hair density—⅛ inch;

Nickel Ferrule: length—2½ cm, width—¼ inch;

Deep Purple (eggplant hue) Wooden Handle: width—1 cm, length—6 cm;

Primary Red rhinestone—2.5 mm;

Applies concealor/spot treatment;

Result—eye make-up blender, eyeliner, lip brush.

Exemplary Construction of Powder Brushes

Exemplary construction of Powder Brushes may include assembly and/or integration of the following components:

Powder Brush (4½ inches)—Hair (Natural Goat—brownish red hair color) 1½ inches from tip of hairs to Nickel Ferrule, width of hairs—¾ inch;
Hair density—¾ inch;
Nickel Ferrule: length—3 cm, width—1½ cm;
Deep Purple Wooden Handle: width—1½ cm, length—2 inches;
Primary Yellow rhinestone—3 mm;
Applies powder, bronzer, and blush;
Result—contour cheeks, neck, chin.

Exemplary Construction of Eyeshadow Brushes

Exemplary construction of Eyeshadow Brushes may include assembly and/or integration of the following components:

Eyeshadow Brush (4¼ inches)—Hairs (Natural Pony) 1 cm from tip of hairs to
Nickel Ferrule, width of hairs—1 cm, hair density—½ cm;
Nickel Ferrule: length—3½ cm, width—1 cm;
Deep Purple Wooden Handle: width—1 cm, length—2⅜ inches;
Secondary Green rhinestone—2.5 mm, Caribbean Water Blue rhinestone—2.5 mm;
"Fairweather Faces" hotstamped in Silver; middle of brush;
Rhinestone(s)—right side of Fairweather Faces; in the case of two rhinestones—green, blue; Fairweather Faces (space) then Rhinestones: Green to the left/Blue to the right (All Colors guided by Standard Color Wheel).

Exemplary Construction Method of Brushes

Exemplary construction methods of Professional and Mini Makeup Brushes may include the following actions, steps and/or stages:

Creating Brushes—Wrap Nickel Ferrule around brush hairs; press Nickel Ferrule in order to tightly hold hairs.

Generally, conventional make-up brushes are used for one purpose per brush, under the prior art. Therefore the client conventionally must purchase multiple brushes (minimum eight or more) in order to address all aspects of the face during the make-up application.

A Multi-functional brush can be used for additional purposes other than its obvious functions (identified via the Names of each Brush) and can be used immediately (after cleansing with a tissue) in several make-up bases (fluids, powders, creams, gels). The unique multi-functionality aspect is achieved by flattening and firmly holding the hairs between thumb and index fingers (1) cutting the brush hairs on 90 degree angles, across the top of the exposed hairs (other half is held by Nickel Ferrule); (2) cutting 45 degree angles on the sides of the brush hairs, to create a dome-like effect (3) Splicing: cutting technique, at a 90 degree angle, gently, sparingly, straight down in the center of the hairs, in order to effortlessly release cosmetic color on face/body and to allow the brushes to be used immediately in all make-up bases without having to fully wash the brush (Generally—wash with shampoo, rinse with water, air dry for 2-3 hours); hairs are cleansed faster by using a dry tissue (gently, swiping the brush hairs, back and forth—releases color much faster); now you can immediately use brush(s) in other make-up base (s). Simply tissue off hairs in between each make-up base use.

Add a drop of wood glue to top/sides of Wooden Handles; slide Wooden Handles into Nickel Ferrules (metal piece that holds together brush hairs on one end/brush handle on the other end); let dry for 24 hours. Paint handles, Black for Professional Make-up Brushes, or Deep Purple (deeper hue of purple) for Mini Brushes. Dry for 24 hours.

Hot stamp—imprint the name by making a plate with indented name and filling it with desired color; press the indented, colored name onto desired surface (in Silver color: "Fairweather Faces" on one brush side), dry for 24 hours. Add circle shaped, Colored Rhinestones (Mini Brushes) on handles with a drop of wood glue; dry for 24 hours. Repeat Hot stamp process (with brush Name) on other side of Professional Make-up Brushes.

EXEMPLARY EMBODIMENTS

Various exemplary embodiments are possible in accordance with the invention. Numerous applications of these embodiments are contemplated as well. For example, exemplary embodiments in accordance with the invention include an Original Face Chart and assorted Theme Face Charts for a Summer Face, Bride Face, Holiday Face, Teen Face, etc.

Described below are several specific examples of embodiments in accordance with the invention. The examples are not intended to limit the scope of the invention, which is defined by the claims issuing herefrom.

Example 1

A first exemplary Color-Coded Face Chart (card) is an effective tool to guide the user on how to apply a quicker and improved, professional make-up design. The face chart may be two-sided, having a first side and a second side.

A first side may include Make-up Brushes and application instructions. As shown in FIG. 8, the Design may include an arrangement of "Fairweather Faces (Professional, Travel Size) Make-up Brushes" (may appear in Black, in the top, middle of card). A caption may read: "These 'space-saver/multi-functional brushes' are not only cute but a necessary tool for Professional Make-up Artists and Everyday Clientele. The hairs are cut in layers to create an effortless, flawless make-up application." The caption may be written in white letters, on black ½ inch background. Brushes may be Color-Coded in five different ways, in Color-Coded order (used to reinforce the Color-Coded system—Red: Skin/Yellow: Powder/Green: Eyes base color, Blue: Eye define/liner; all Color-Coded colors maybe used interchangeably). Reinforcement of color-coding may include, for instance: (1) Color-Coded border around photo of Professional and/or Mini Brushes (located to the left of card); (2) Color-Coded Brush Name and/or Category, located to the right, of the brush(es) photo(s); Brushes Purpose stated in black ink, to the right of Brush Name; and (3) Bonus—additional usage that is listed in Color-Coded colors, located below Brushes Purpose. The words "Brush Care" may appear in white lettering, in a Black background box, ½ cm width, 2 cm length box. Instructions may be located to the right of box in Black, on White background.

The second side may depict a Model Face. Color-Coded Dots appear on left side of Face in FIGS. 6, 7, and 10 to indicate where each makeup type should be applied. The color-coded dots appear in front of the Before look of bare skin without makeup. The right side of Face displays the make-up application finish in brown hues (After look). Color-Coded Dots located to the right of the Model Face, in a Column on the far right side of the second side, in their appropriate Category, is the Professional Make-up Application process. Below the Column may be a Box containing an additional Eye Make-up design, and/or additional Beauty Tips and/or Suggestions. The bottom of the second side may include business information, such as "Fairweather Faces FACE CHART (718)398-6938 www.Fairweatherfaces.com" that may appear to the left of Box, in light gray letters with black background.

The Model Face may be etched in dark/light gray, having Charcoal black outlines features—eyebrows, nose, eyes, lips, hair, chin, neck. The Model Face may have Brown eyes, Black lashes, and Toffee colored lips. A base of eyeshadow may be a warm brown—outer corner of eye/milk chocolate brown on the outer, outer corner of eye/outer lower lashes. Light gray marks the area for blush application, whereas Dark gray marks areas for bronzer/contour application.

As depicted on the left side of Face Chart of FIG. 6, corresponding to the right of the Model Face, one Green Dot appears on a center of eye lid; two Blue Dots appear, one on outer top/one on outer bottom corner of eye; two Red Dots appear, one on orbital bone (right side of eye—½ cm below), one located 1 inch below other red dot; two Yellow Dots appear, one is 1 inch down from middle of the eye (slightly to the left), one is ½ cm from left side of card edge.

The face chart of FIG. 6 also includes an Additional Box with additional eye design at the lower right corner; an exemplary size is: Across—1 inch, Down—1¼ inches. Four Green Dots appear, one directly below the eyebrow (in center) three on eyelid (one close to inner eye corner, one above the left side of eye, one above right side of eye—all placed one behind the other except for the above one, which is stacked between the second and third green dots). Five Blue Dots also appear, two directly below the eyebrow, two directly below them (one directly behind the third green dot), with one slightly angled up, to the right of that dot; and one on the outer corner, below all blue dots.

Referring to FIG. 6, the column has light gray background, and the Box/Model Face have light gray borders. The Face Chart has a black border (measurement—½ cm from top to line of border at the top of Face; ¼ inch from edge of light gray column to edge of card (on right side); 1 inch—From bottom of Model Face to the bottom of card; ½ cm from edge of Face Chart to edge of card (left side); with slightly lighter gray background displayed on left side of Model Face between left ear and neck (1½ cm) at the bottom near neck, and decreases to (⅛ inch) at the base of left ear; Right side—bottom of neck (⅝ inches) and decreases up to (⅛ inches).

In general, the face chart may have a UN Glossy, protective coating on both sides of Face Chart card. Exemplary Measurements are 4×6 inches. Exemplary Paper may include 15 point cardstock (card thickness).

Example 2

A second exemplary Color-Coded Face Chart (card) may be a Themed Face Chart, as shown in FIG. 10. Themed Face Charts also may be two-sided, having a first side and a second side. Themed Face Charts may be known by names such as Original Face Chart, Teen Face, Summer Face, Bridal Face, and more. A Theme Face Chart may share the same overall layout as the original Face Chart except that the name of theme is stated at the top, middle of the forehead. Theme-specific or theme-appropriate Additional Beauty/Tips/Suggestions may be located in the Column and/or Additional Box. For instance, the Additional Box may contain additional eye make-up, and/or other beauty/make-up design(s) with or without additional Beauty/Tips/Suggestions. Additional Make-up Shade Box(es) added to the column (underneath the appropriate category) may give clients visual options of the various shades they can choose to wear.

In conjunction with an Original Face Chart or a Theme Face Chart, matching brushes may be provided to complete a makeup application system. The handle or nickel plate of the brush can be decorated with any of the following: Stones (all properties/elements: i.e., diamond(s) or rhinestone(s)) or metal(s) or cloth(s) or wood(s) or vinyl(s) or glass(es) or plexi-glass(es) or gravel stone (s) or specialized stones (quartz, mother of pearl, and the like), Fluid(s) or Gel(s) or Cream(s) or Paint(s) or Paper(s) or Cardboard(s) or Flower(s) or Feather(s) or Carpet(s) in whole or part, or Light(s) or Glitter(s) or Plastic(s) or Seals (of any kind) of various colors, forms, shapes, sizes, on the Make-up Brushes.

Embodiments of the invention may include several aspects and advantages. Some of the possible aspects and advantages may be summarized as follows:

- Color-Coded system: five different ways to guide make-up brush usage and professional make-up application process.
- Directions: Match Color-Coded Make-up Brush to the Dot on Face Chart, and SNAP! Apply your Make-up like the Pros.
- Color-coded, travel size, multi-functional Make-up Brushes: allows one to two additional usages per make-up brush.
- Travel sized Face Chart: an easy-to-carry, postcard-sized, high-gloss card guides the Color-Coded system.
- Themes for Face Charts: in addition to the Original Face Chart, other Face Charts may depict, for instance, a Holiday Face, Teen Face, Summer Face, Bridal Face, or other conceivable themes!
- Color-Coded colors: markings may use colors in various forms—Dots on Model Face and in Categories, such as along a Column. Face Charts may use a column to set forth the Make-up Application process, Borders, Brush Names, and Bonus, in Primary Red, Primary Yellow, Secondary Green and Primary Blue.
- Embellishments: brushes may include embellishments, such as stones in various colors, to function as matching markings as well as brush decorations.

In accordance with aspects of the invention, now the Beauty Industry has a way to take the guess work out of how, when, and where to use make-up brushes and to quicken and improve the make-up application process. One will use fewer make-up brushes, yet get multiple usages from each brush. With the gentle swipe of the brush with a tissue, one can almost immediately re-use the make-up brushes in a variety of make-up bases. The travel size make-up brushes and face chart may save both space and money. In addition, a user may simplify the professional make-up application process via the Color-Coded system. Primary Red, Yellow, Blue, and Secondary Green colors may be used in several different ways via the Face Chart, a tool used to guide a professional make-up application, make-up brush usage, and beauty tips. Match Color-Coded Make-up Brush to the Dot on Face Chart and SNAP! Apply your Make-up like the Pros. The Color-Coded system also may be used in various forms (with or without embellishments on the brush handles).

The foregoing description discloses exemplary embodiments of the invention. While the invention herein disclosed has been described by means of specific embodiments and applications thereof, numerous modifications and variations could be made thereto by those skilled in the art without departing from the scope of the invention set forth in the claims. Modifications of the above disclosed apparatus and methods that fall within the scope of the invention will be readily apparent to those of ordinary skill in the art. Accordingly, other embodiments may fall within the spirit and scope of the invention, as defined by the following claims.

In the description above, numerous specific details are set forth in order to provide a more thorough understanding of embodiments of the invention. It will be apparent, however, to an artisan of ordinary skill that the invention may be practiced without incorporating all aspects of the specific details described herein. In other instances, specific details well known to those of ordinary skill in the art have not been described in detail so as not to obscure the invention. Readers should note that although examples of the invention are set forth herein, the claims, and the full scope of any equivalents, are what define the metes and bounds of the invention.

What is claimed is:

1. A method of assisting a user in application of make-up, the method comprising:

providing the user with a face chart product, the face chart product comprising a postcard-sized card having a first card surface, the first card surface depicting a face chart and a code key situated alongside the face chart and explaining the face chart;

wherein the face chart comprises:

a makeup application strategy, and an image of at least a portion of a human face, wherein the makeup application strategy comprises a plurality of distinct makeup applications;

wherein the image includes a first side of the human face depicting bare skin and a plurality of coded indications on the bare skin, each coded indication using codes on the code key and identifying a makeup application location of a makeup type; and wherein the image includes a second side of the human face depicting the plurality of distinct makeup applications applied to the human face at corresponding locations mirroring the makeup application locations, providing the user with a plurality of multi-functional cosmetics brushes, each of which is suitable for applying one or more of the plurality of distinct makeup applications, wherein the cosmetics brushes have markings matching codes on the face chart to associate each cosmetics brush with at least one corresponding makeup application; wherein the multi-functional cosmetics brushes are travel-sized and not longer than 4.5 inches from an end of a handle to an opposite end of a pile of brush hairs; wherein a ferrule tightly wraps around the pile of brush hairs; wherein the ferrule is affixed to the handle; and wherein each of the multi-functional cosmetics brushes includes a pile of brush hairs that have been (1) cut on 90 degree angles across a top of the pile of brush hairs protruding from the ferrule, (2) cut on 45 degree angles on sides of the pile of brush hairs to create a dome-like effect, and (3) sparingly spliced at 90 degree angles straight down in a center of the pile of brush hairs;

instructing the user to associate each cosmetics brush with the at least one corresponding makeup application by matching the markings with the codes;

instructing the user to apply the makeup types using the cosmetics brushes to create the plurality of distinct makeup applications in accordance with the makeup application strategy.

2. The method of claim 1, wherein the markings include colored rhinestones, whereas the codes include colored dots having colors that match the colors of the rhinestones; wherein the plurality of distinct makeup applications involves a plurality of cosmetics; and wherein the plurality of cosmetics includes at least two of a group comprising foundation, concealor, blush, bronzer, powder, eye shadow, and eye liner.

3. A system for assisting a user in application of make-up, the system comprising:

a postcard-sized card having a first card surface, the first card surface depicting a face chart and a code key situated alongside the face chart and explaining the face chart;

wherein the face chart comprises:

a makeup application strategy, and an image of at least a portion of a human face, wherein the makeup application strategy comprises a plurality of distinct makeup applications;

wherein the image includes a first side of the human face depicting bare skin and a plurality of coded indications on the bare skin, each coded indication using codes on the code key and identifying a makeup application location of a makeup type; and wherein the image includes a second side of the human face depicting the plurality of distinct makeup applications applied to the human face at corresponding locations mirroring the makeup application locations;

a plurality of multi-functional cosmetics brushes, each of which is suitable for applying one or more of the plurality of distinct makeup applications, wherein the cosmetics brushes have markings matching codes on the face chart to associate each cosmetics brush with at least one corresponding makeup application; wherein the multi-functional cosmetics brushes are travel-sized and not longer than 4.5 inches from an end of a handle to an opposite end of a pile of brush hairs; wherein a ferrule tightly wraps around the pile of brush hairs; wherein the ferrule is affixed to the handle; and wherein each of the multi-functional cosmetics brushes includes a pile of brush hairs that have been (1) cut on 90 degree angles across a top of the pile of brush hairs protruding from the ferrule, (2) cut on 45 degree angles on sides of the pile of brush hairs to create a dome-like effect, and (3) sparingly spliced at a 90 degree angle straight down in a center of the pile of brush hairs;

instructions to associate each cosmetics brush with the at least one corresponding makeup application by matching the markings with the codes; and instructions to apply the makeup types using the cosmetics brushes to create the plurality of distinct makeup applications in accordance with the makeup application strategy.

4. The system of claim 3, wherein the markings include colored rhinestones, whereas the codes include colored dots having colors that match the colors of the rhinestones; wherein the plurality of distinct makeup applications involves a plurality of cosmetics; and wherein the plurality of cosmetics includes at least two of a group comprising foundation, concealor, blush, bronzer, powder, eye shadow, and eye liner.

5. A face chart product comprising:

a piece of glossy postcard-sized card stock, the card stock having a front side and a back side, wherein a face chart and a code key appear on the front side, the face chart comprising:

a makeup application strategy, and an image of at least a portion of a human face, and the code key situated alongside the face chart and explaining the face chart, wherein the makeup application strategy comprises a plurality of distinct makeup applications;

wherein the image includes a first side of the human face depicting bare skin and a plurality of coded indications on the bare skin, each coded indication using codes on the code key and identifying a makeup application location of a makeup type; and wherein the image includes a second side of the human face depicting the plurality of distinct makeup applications applied to the human face at corresponding locations mirroring the makeup application locations;

wherein the code key also corresponds to a plurality of multi-functional cosmetics brushes, each of which is suitable for applying one or more of the plurality of distinct makeup applications, wherein the cosmetics brushes have markings matching codes on the face chart to associate each cosmetics brush with at least one corresponding makeup application; and wherein the multi-functional cosmetics brushes are travel-sized and not longer than 4.5 inches from an end of a handle to an opposite end of a pile of brush hairs; wherein a ferrule tightly wraps around the pile of brush hairs; wherein the ferrule is affixed to the handle; and wherein each of the multi-functional cosmetics brushes includes a pile of brush hairs that have been (1) cut on 90 degree angles across a top of the pile of brush hairs protruding from the ferrule, (2) cut on 45 degree angles on sides of the pile of brush hairs to create a dome-like effect, and (3) sparingly spliced at a 90 degree angle straight down in a center of the pile of brush hairs.

6. The face chart product of claim 5, wherein the code key includes makeup information matching the coded indication with the makeup type.

7. The face chart product of claim 6, wherein the code key includes brush information matching the coded indication and the makeup type with a cosmetics brush.

8. The face chart product of claim 6, further comprising:

a bonus section depicting a more detailed eye shadow makeup strategy;

wherein the second side of the human face depicts stylized makeup, the stylized makeup corresponding to a possible result of makeup application in accordance with the makeup application strategy.

9. The face chart product of claim 7, further comprising further makeup application assistance information.

10. The face chart product of claim 9, wherein the further makeup application assistance information includes one or more of: (1) details about brush appearance, type, purpose, functionality, versatility, and/or cleaning; (2) recommended makeup; (3) a photo of a discussed brush; and/or (4) details how to use the face chart in conjunction with the coded brushes.

11. The face chart product of claim 9, wherein the further makeup application assistance information appears on the back side.

12. The face chart product of claim 5, wherein the multi-functional cosmetics brushes include a concealor brush having brush hairs made of synthetic Taklon, a powder brush having brush hairs comprising natural goat hairs, and an eye shadow brush having brush hairs comprising natural pony hairs; wherein each handle comprises wood; and wherein each ferrule comprises nickel.

13. The method of claim 1, wherein the multi-functional cosmetics brushes include a concealor brush having brush hairs made of synthetic Taklon, a powder brush having brush hairs comprising natural goat hairs, and an eye shadow brush having brush hairs comprising natural pony hairs; wherein each handle comprises wood; and wherein each ferrule comprises nickel.

14. The system of claim 3, wherein the multi-functional cosmetics brushes include a concealor brush having brush hairs made of synthetic Taklon, a powder brush having brush hairs comprising natural goat hairs, and an eye shadow brush having brush hairs comprising natural pony hairs; wherein each handle comprises wood; and wherein each ferrule comprises nickel.

15. The system of claim 14, further comprising four standard-sized professional brushes having standard lengths between 4.5 inches and 5.75 inches and including a camouflage brush with brush hairs made of synthetic Taklon, a chisel brush with brush hairs comprising natural goat hairs, a fluff brush with brush hairs comprising natural pony hairs, and a detail/deluxe duo brush with brush hairs comprising natural pony hairs.

* * * * *